US011054114B1

(12) United States Patent
Kelly et al.

(10) Patent No.: US 11,054,114 B1
(45) Date of Patent: Jul. 6, 2021

(54) ILLUMINATING, SPINNING DEVICE

(71) Applicant: LIGHTUPTOYS.COM LLC, Sellersburg, IN (US)

(72) Inventors: Christopher D. Kelly, New Albany, IN (US); Joshua C. Kelly, Sellersburg, IN (US); Max Armendariz Lalama, Georgetown, IN (US)

(73) Assignee: LightUpToys.com LLC, Sellersburg, IN (US)

( * ) Notice: Subject to any disclaimer, the term of this patent is extended or adjusted under 35 U.S.C. 154(b) by 0 days.

(21) Appl. No.: 17/109,710

(22) Filed: Dec. 2, 2020

Related U.S. Application Data

(60) Provisional application No. 62/944,073, filed on Dec. 5, 2019.

(51) Int. Cl.
*F21V 14/00* (2018.01)
*F21V 14/02* (2006.01)
*F21Y 115/10* (2016.01)

(52) U.S. Cl.
CPC ..... *F21V 14/025* (2013.01); *F21Y 2115/10* (2016.08)

(58) Field of Classification Search
CPC ..... F21V 14/025; A63H 33/22; A63H 33/26
USPC ..... 362/36; 446/242
See application file for complete search history.

(56) References Cited

U.S. PATENT DOCUMENTS

| | | | | |
|---|---|---|---|---|
| 6,589,094 | B2 | 7/2003 | Spencer | |
| 7,771,247 | B2 * | 8/2010 | Kessler | A63H 33/26 446/242 |
| 2009/0133299 | A1 * | 5/2009 | Blackwell | G09G 3/14 40/212 |
| 2013/0309940 | A1 | 11/2013 | Miyako | |

* cited by examiner

*Primary Examiner* — Karabi Guharay
(74) *Attorney, Agent, or Firm* — Scott R. Cox; Jessica C. Ronald

(57) ABSTRACT

An illuminating, spinning device that includes a housing containing a motor that is electrically connected to a power source and a shaft that extends vertically from the motor. A printed circuit board is connected to the shaft and contains a LED display secured thereto. A base is also connected to the shaft, preferably atop the printed circuit board, and the base and the printed circuit board rotate about the shaft in synchronization. An object is secured to the base adjacent to an LED. The LED display produces a moving animation when rotating about the shaft. The base, object and printed circuit board are further surrounded by an enclosure.

20 Claims, 10 Drawing Sheets

ILLUMINATING, SPINNING DEVICE

CROSS REFERENCE TO RELATED APPLICATION

This application claims priority from provisional application Ser. No. 62/944,073 filed Dec. 5, 2019.

FIELD OF INVENTION

The present invention relates generally to a device that spins and illuminates using different LED displays. More particularly, the invention is a handheld device with a spinning top portion, which portion includes a LED display and an illuminating object, both of which spin together upon a shaft.

BACKGROUND OF INVENTION

Handheld device that illuminate and spin exist, such as those disclosed in U.S. Pat. No. 6,589,094. However, the light illuminated from these devices emanate from individual LEDs and do not generate a pattern or a moving animation while spinning. The illumination provided by these devices emanate from LEDs that illumate independently of one another.

SUMMARY OF INVENTION

An illuminating, spinning device that includes a housing containing a motor that is electrically connected to a power source and a shaft that extends vertically from the motor. A printed circuit board is connected to the shaft and contains a LED display secured thereto. A base is also connected to the shaft, preferably atop the printed circuit board and the base and the printed circuit board rotate about the shaft in synchronization. An object is secured to the base adjacent to the LED display and the LED display produces a moving animation when rotating about the shaft.

DETAILED DESCRIPTION OF THE DRAWINGS

Figure 1:
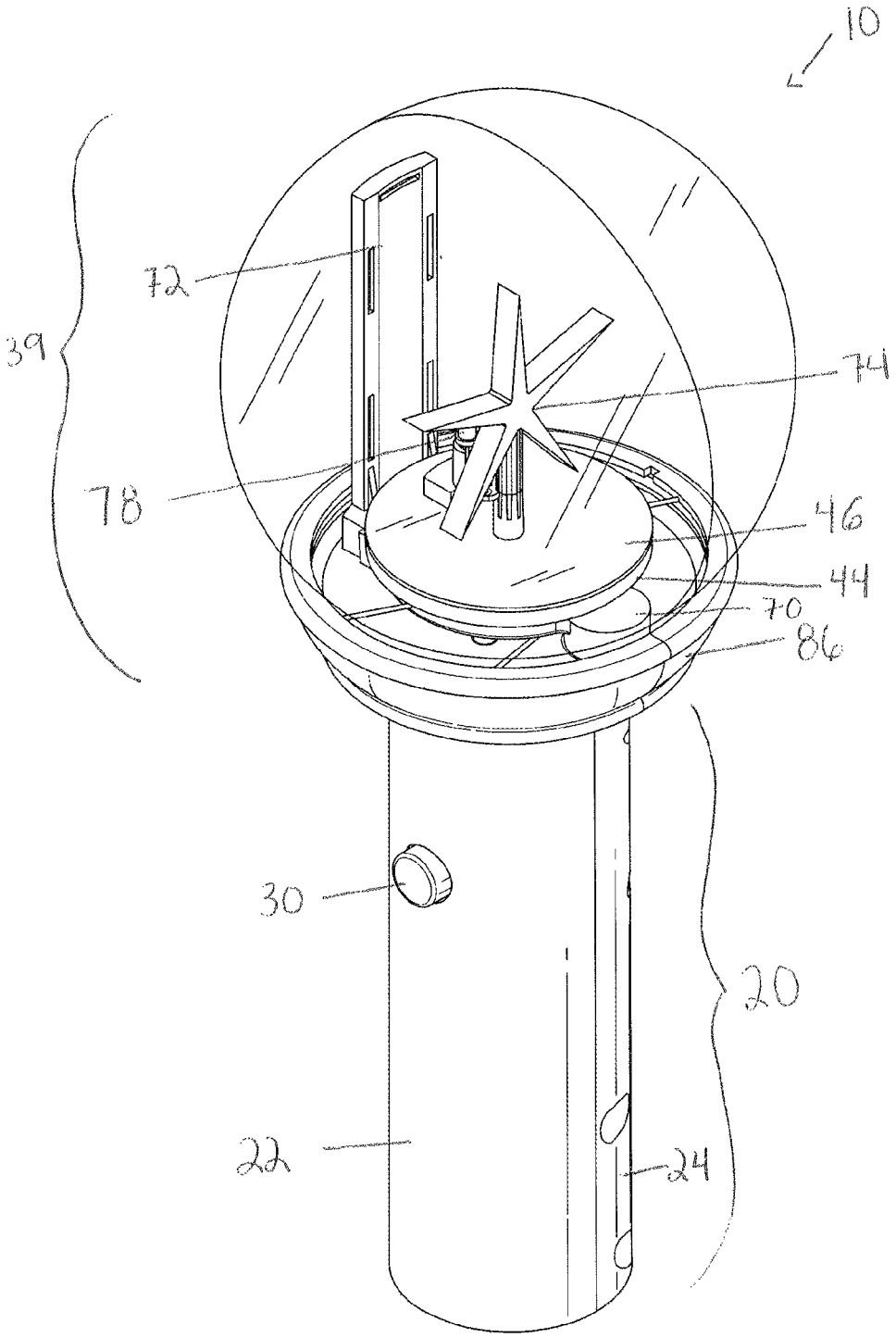
FIG. 1 is a front, perspective view of an illuminating, spinning device.

FIGS. 1-7 show an illuminating, spinning device 10 with a housing 20, a printed circuit board 40, a base 44, a LED display 72, an object 74 and an enclosure 80. In one embodiment, the housing is shaped like a handle for a user to hold the device. The device can be handheld or stand on its own, for example as a display. The housing includes a front casing 22 and a back casing 24. The front and back casing secure together, for instance via screws or glue, to create a housing that contains various components of the device.

Figure 2:
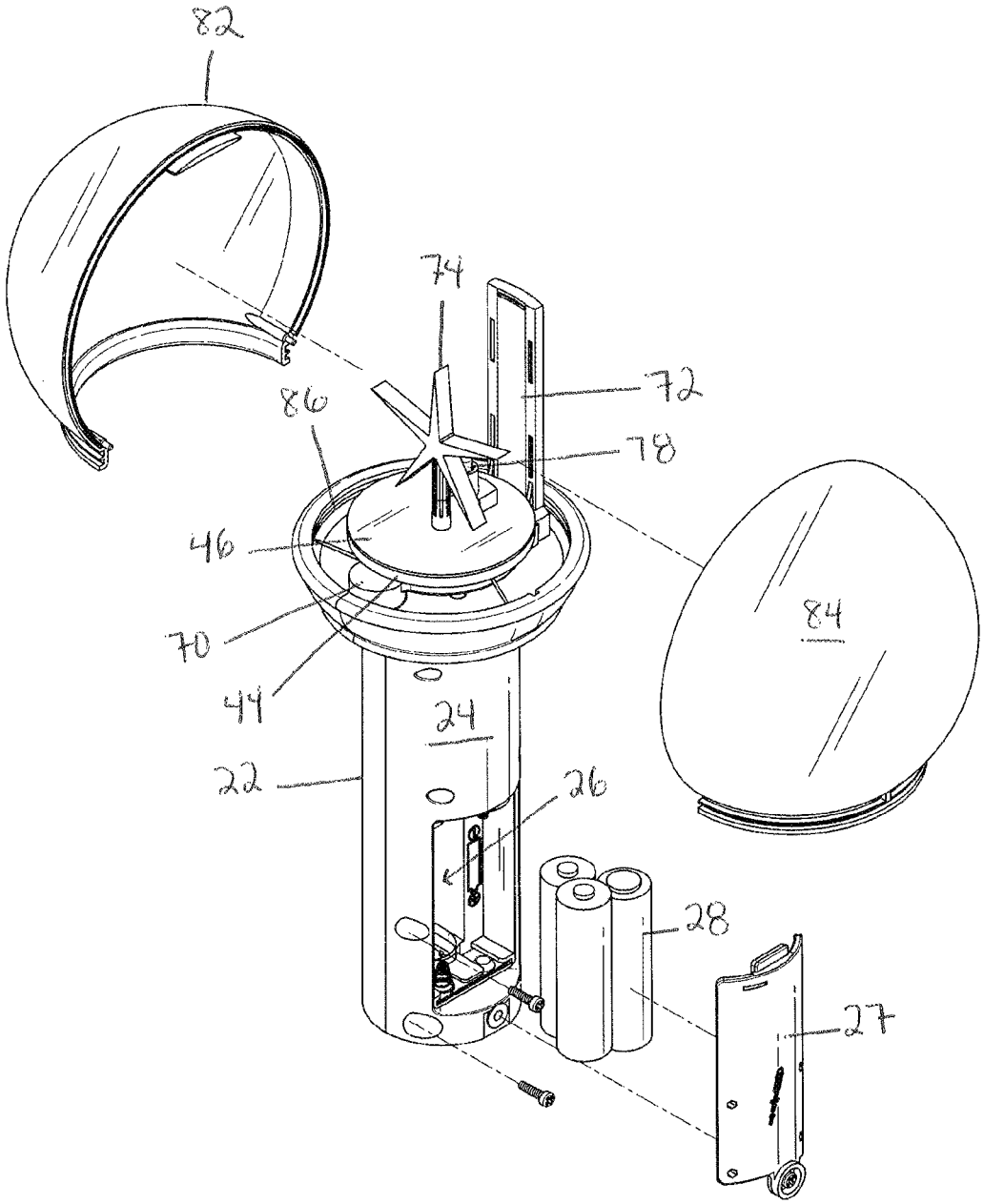
FIG. 2 is a back, perspective view of the device of FIG. 1 with an exploded view of a battery compartment.
Figure 3:
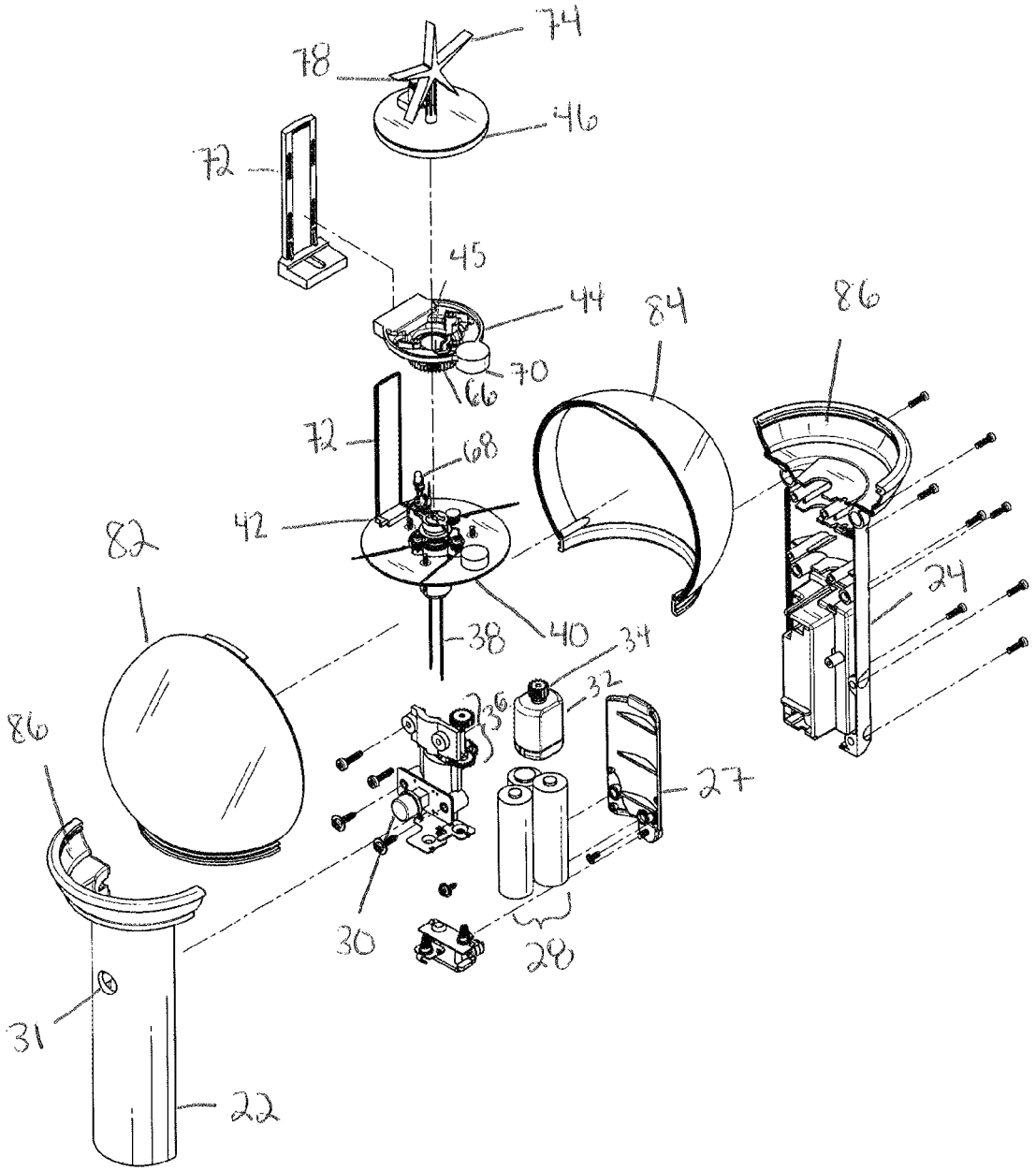
FIG. 3 is an exploded view of the device of FIG. 1.
Figure 4:
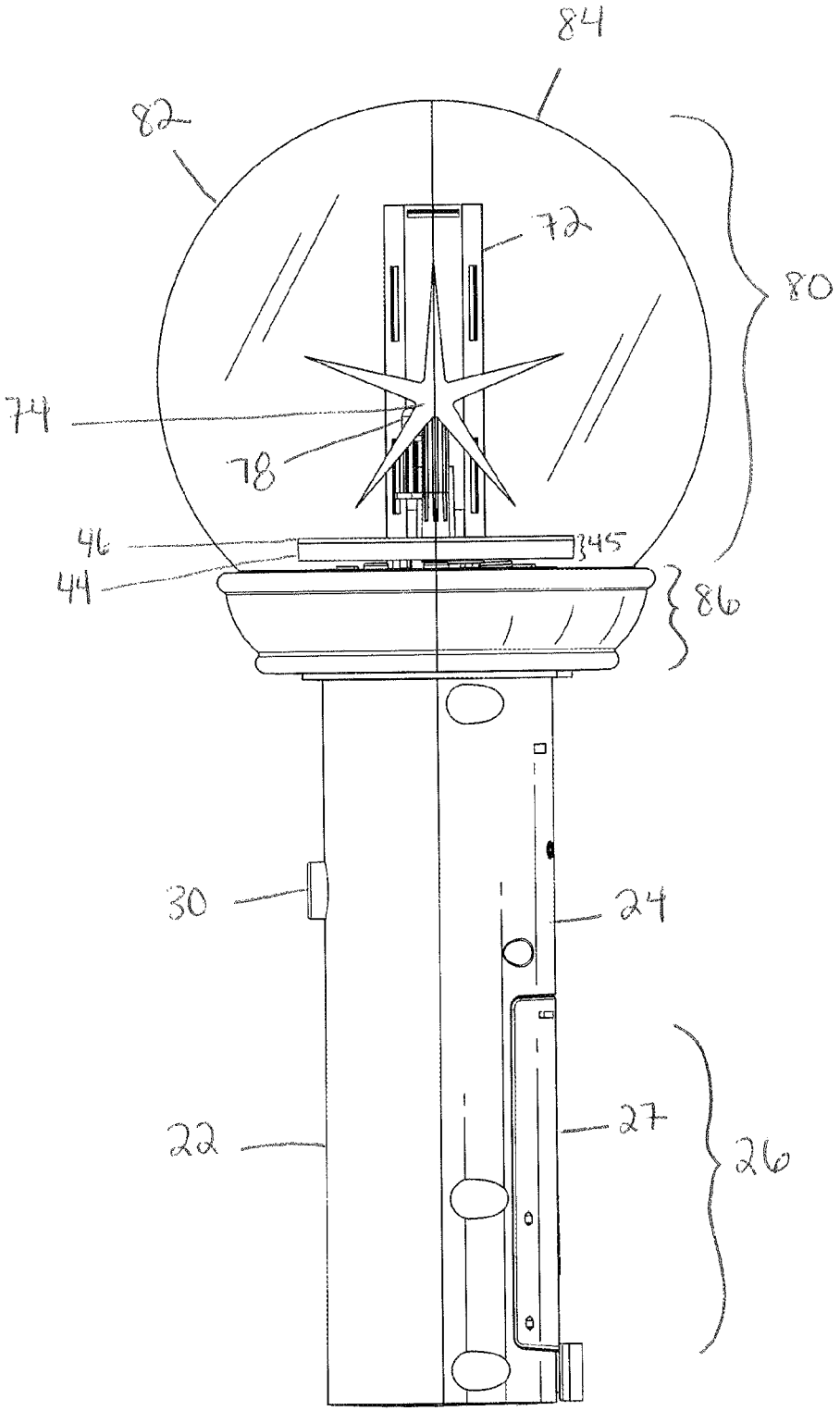
FIG. 4 is a side view of the device of FIG. 1.
Figure 5:
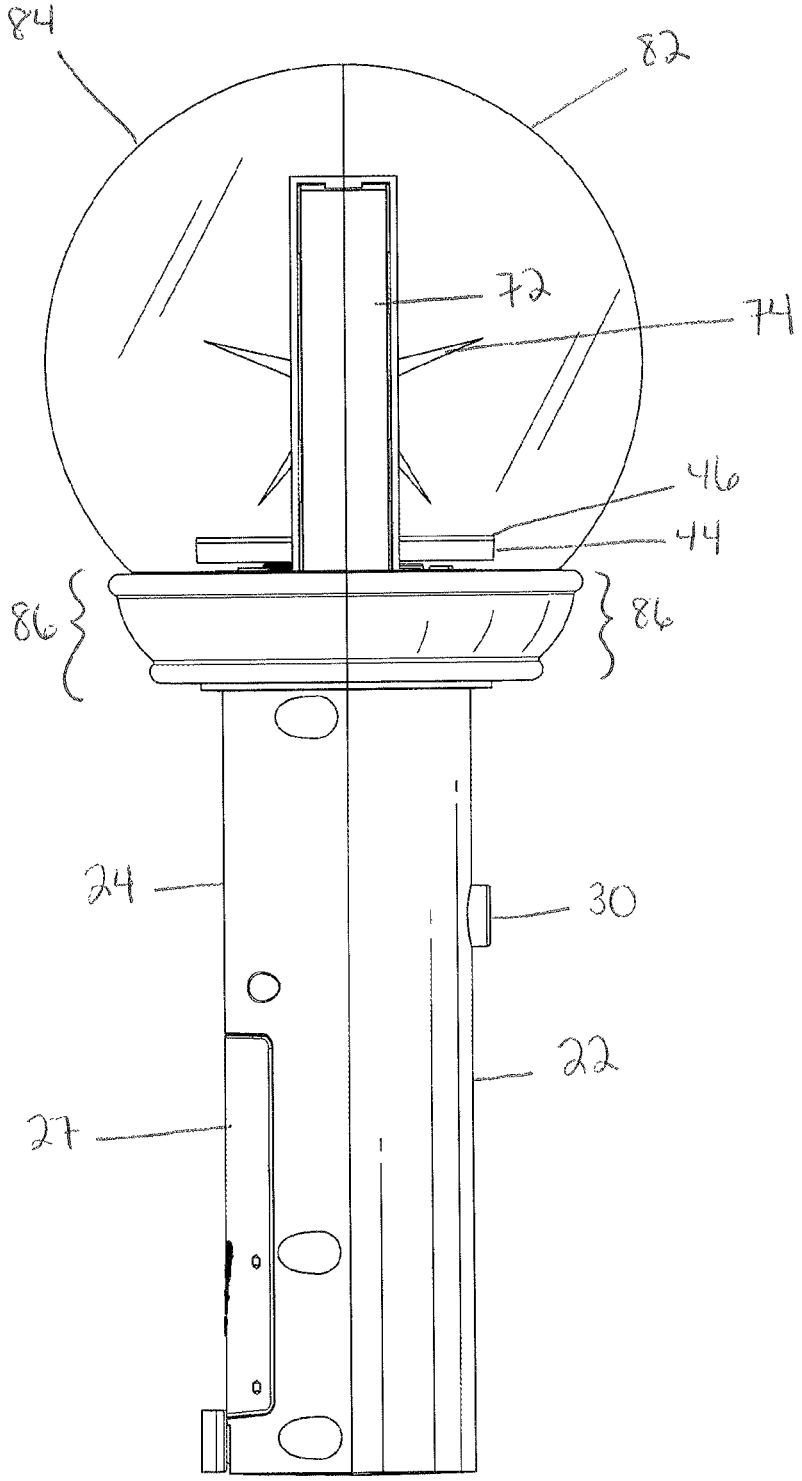
FIG. 5 is side view of the device of FIG. 1, from the side opposite of FIG. 4.

As shown in FIGS. 2-5 and 7, the back casing includes a battery compartment 26. In this embodiment, batteries 28 are the power source driving the device 10 and are secured within the battery compartment via a cover 27 that attaches to the back casing via screws. As shown in FIG. 3, the front casing includes an outlet 31 through which a switch 30 is palpable by a user. This switch is electrically connected via wiring (not shown) to the power source. The switch can be multi-functional to turn on various functions of the device with each pressing of the switch. In one embodiment, when a user presses the switch, it activates a motor 32, which is secured within the housing. For example, the inside of the housing is specifically designed during manufacturing to hold the various electronic components, such as the motor, when the front and back casing are secured together. As shown in FIG. 3, the motor has a worm gear 34 secured to a top portion thereof, which gear works together with a gearbox 36 that is also located within the housing. The gearbox has varying gears within it to control the speed and rotation of the spinning portion of the device. The gearbox is secured via conventional securing methods to the shaft 38 and aids in the rotation of the drive shaft and the top portion 39 of the device.

Figure 9:
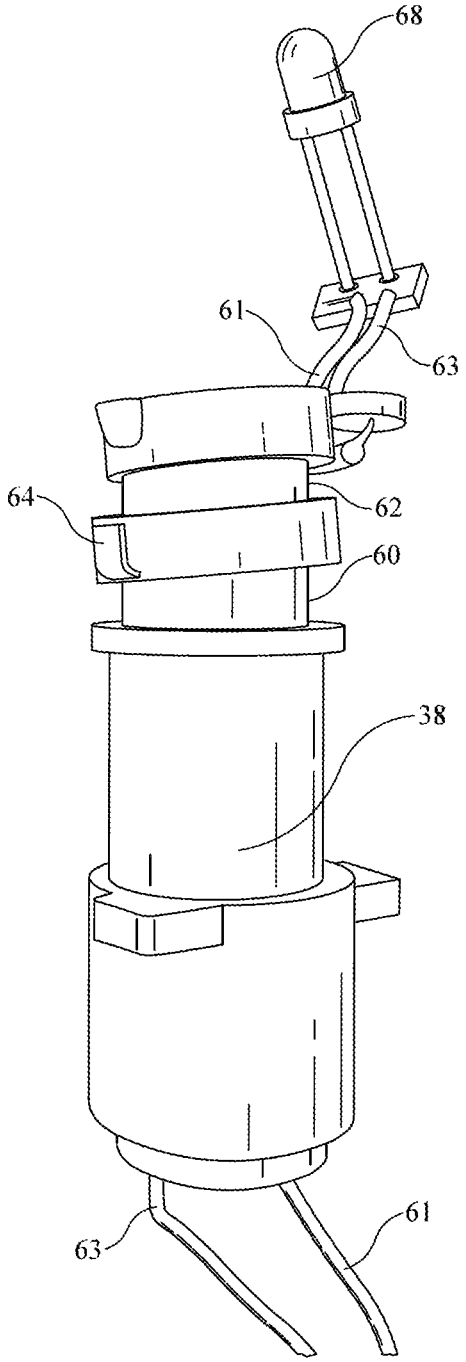
FIG. 9 is a side view of the shaft of the device of FIG. 1.

As shown in FIG. 3, a drive shaft 38 connects to the gearbox 36 and runs vertically upward therefrom though the housing 20. Located within this shaft is wiring that electrically connects to the power source and includes a negative terminal 61 and a positive terminal 63, see FIG. 9. This wiring is soldered to an inner edge of the drive shaft for electrical connection to components located within a base 44, which is located in a top portion 39 of the device 10. The drive shaft extends centrally through the printed circuit board ("PCB") 40. As shown in FIG. 3, the PCB is a planar circular surface, which includes a secure point 42 for the LED display 72. The LED display is secured to the PCB at an outer edge thereof.

Figure 10:
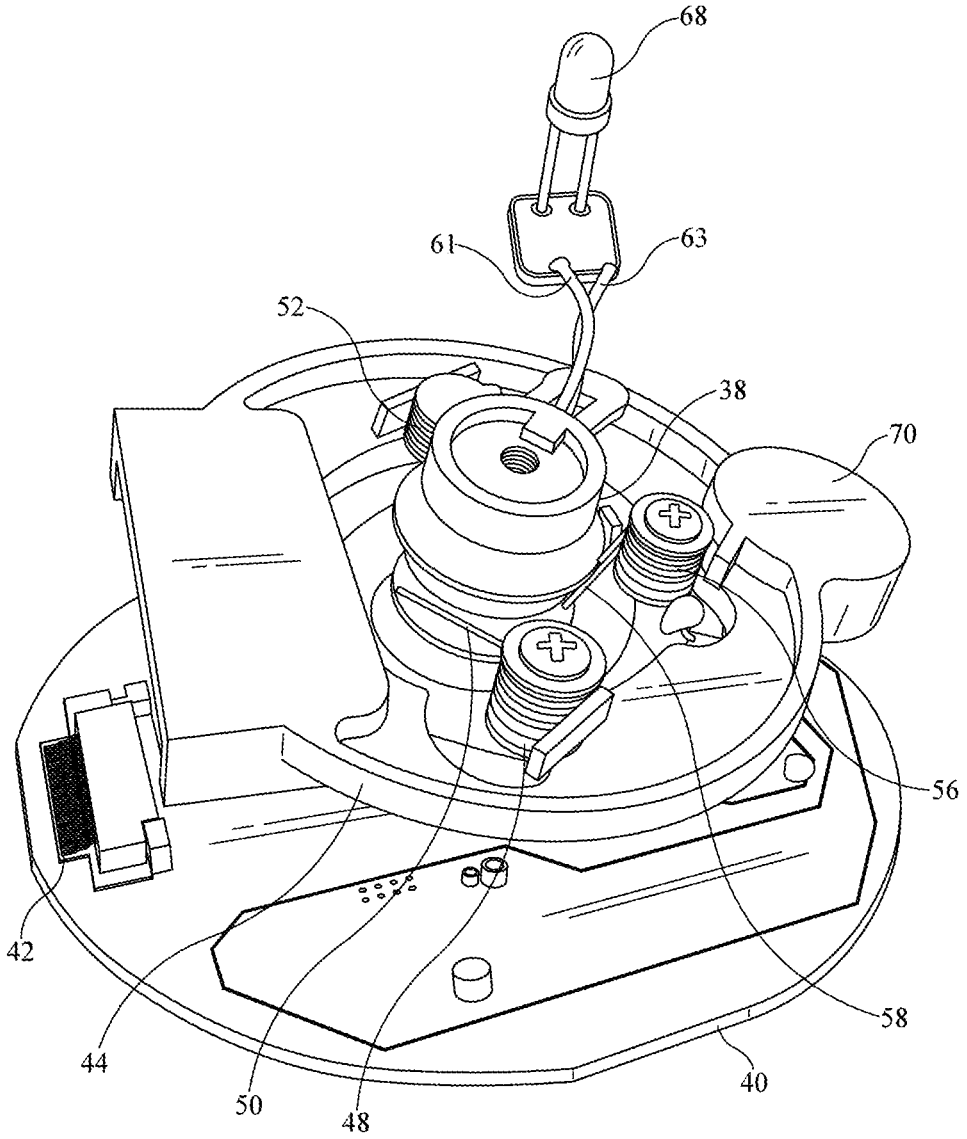
FIG. 10 is top, perspective view of the printed circuit board, the base and the shaft of the device of FIG. 1.

As shown in FIGS. 3 and 10, the drive shaft 38 further extends centrally through a center of the base 44, which base is affixed atop the PCB 40. The base is a flat surface and circular in shape and similar in size to the PCB. The base includes a cover 46, which creates an encasing 45 that houses components. The base and the PCB rotate together about the drive shaft in a synchronized rotation. This synchronized rotation is facilitated by a gear 66 located on a bottom surface of the base, which secures to the drive shaft via conventional securing methods.

As shown in FIGS. 3 and 8-10, located within the encasing 45 is a negative power spring 48 with a negative power arm 50, a positive power spring 52 with a negative power arm 54, and a timing circuit spring 56 with a timing circuit arm 58. These three springs are made of a conductive material, such as a metal, and are located around an outer edge of the base. The arms of these three springs extend inward from the outer edge of the base into a center of the base where the drive shaft 38 is located. This portion of the drive shaft includes a negative power slip ring 60, a positive power slip ring 62 and a timing circuit slip ring. The negative and positive power slip rings are made of a conductive material and completely surround the drive shaft thereby making constant contact with the extending arms of the negative and positive springs, even when the top portion 39 of the device 10 is spinning. The timing circuit slip ring is made mostly of a non-conductive material, such as plastic, but includes a segment that contains a conductive material.

The particular positioning of the conductive material only around one section of this slip ring is to control the animation of the LED display 72. For example, the printed circuit board and this timing circuit work together to time the animated display projected from the LED display to create a novel moving animation when the top portion of the device spins.

As shown in FIG. 3, connected to an end portion of the negative 61 and positive terminals 63 and atop the base 44 is a LED 68. This LED is secured, for instance via glue, to the cover 46 of the base. An object 74 is secured to the cover of the base. The object is preferably secured to the cover adjacent to the LED and is made of a material that is capable of refracting light. In this embodiment, the object is a star, but this should not be construed as limiting, as the object can include any shape desired by the user. The LED display 72, which is connected to the PCB 40 and the object rotate in synchronization about the shaft 38 to create a novel visual animation display. For example, in this embodiment, the object is a star, so the LED display is programmed to produce star images that are produced at different heights on the display and at different times, as controlled by the timing circuit and PCB. Accordingly, when spinning, the LED display creates a moving backdrop for the object, which is situated adjacently thereto. Accordingly, behind the object is the illusion of blinking, moving stars.

Figure 6:
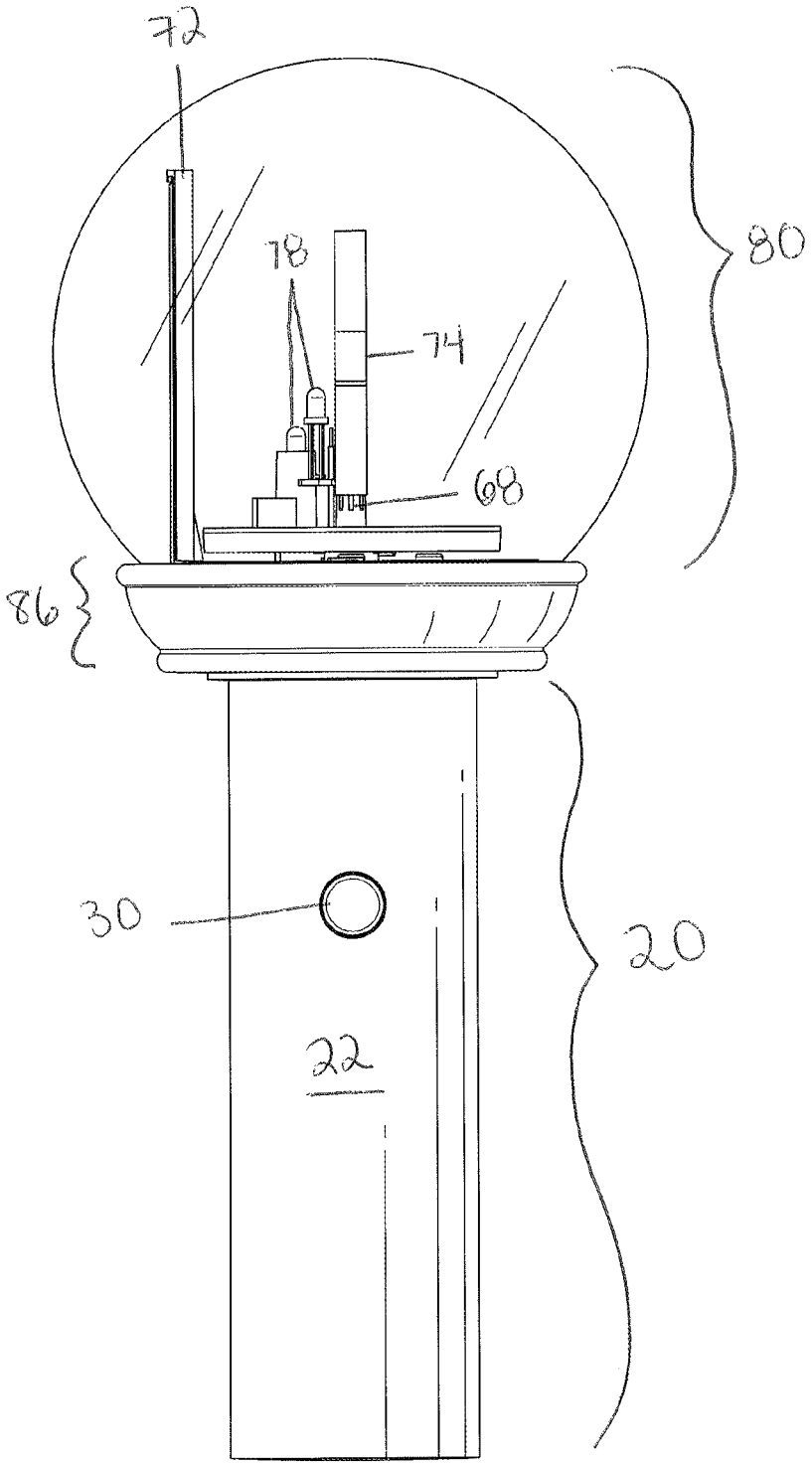
FIG. 6 is a front view of the device of FIG. 1.
Figure 7:
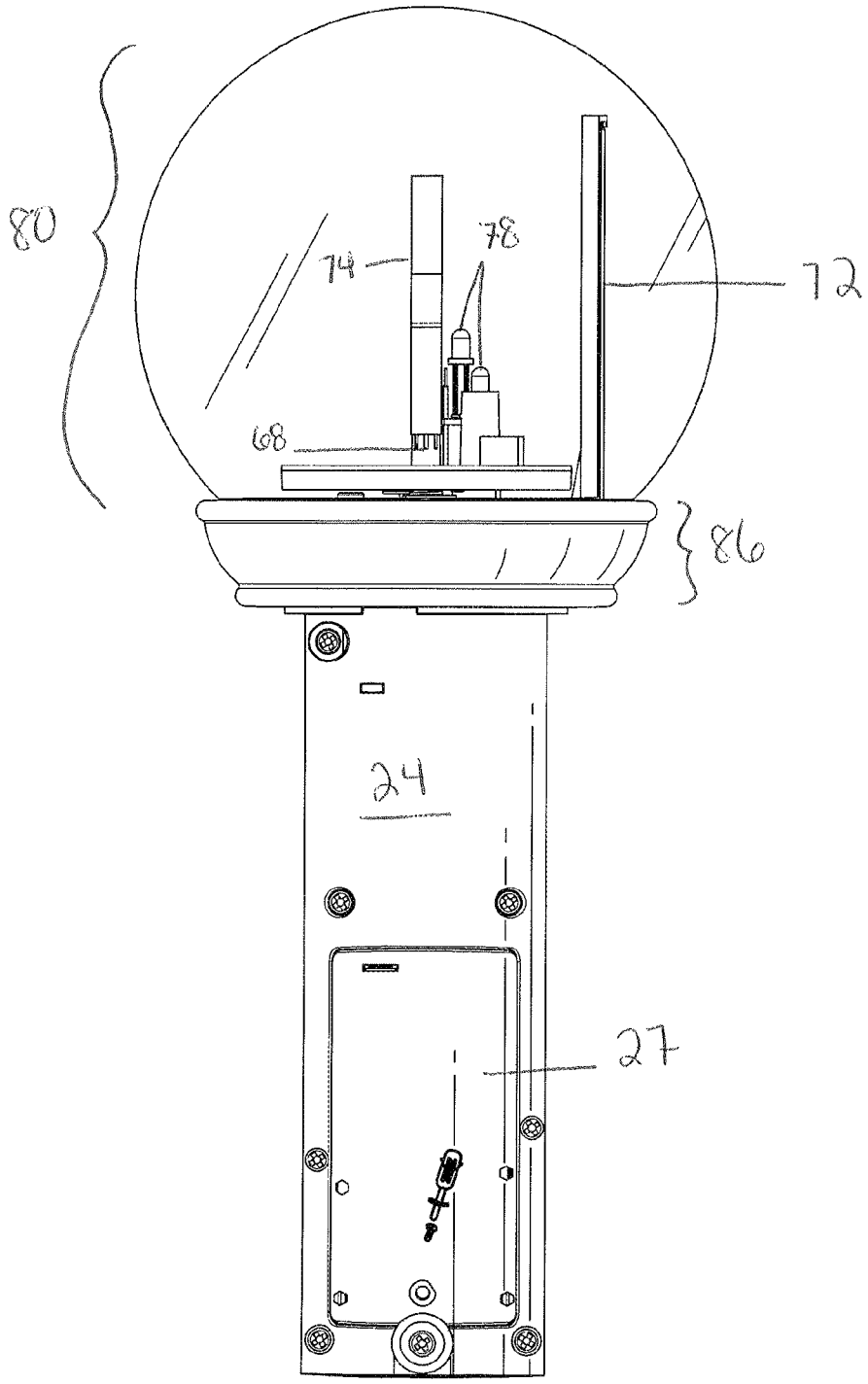
FIG. 7 is a back view of the device of FIG. 1.
Figure 8:
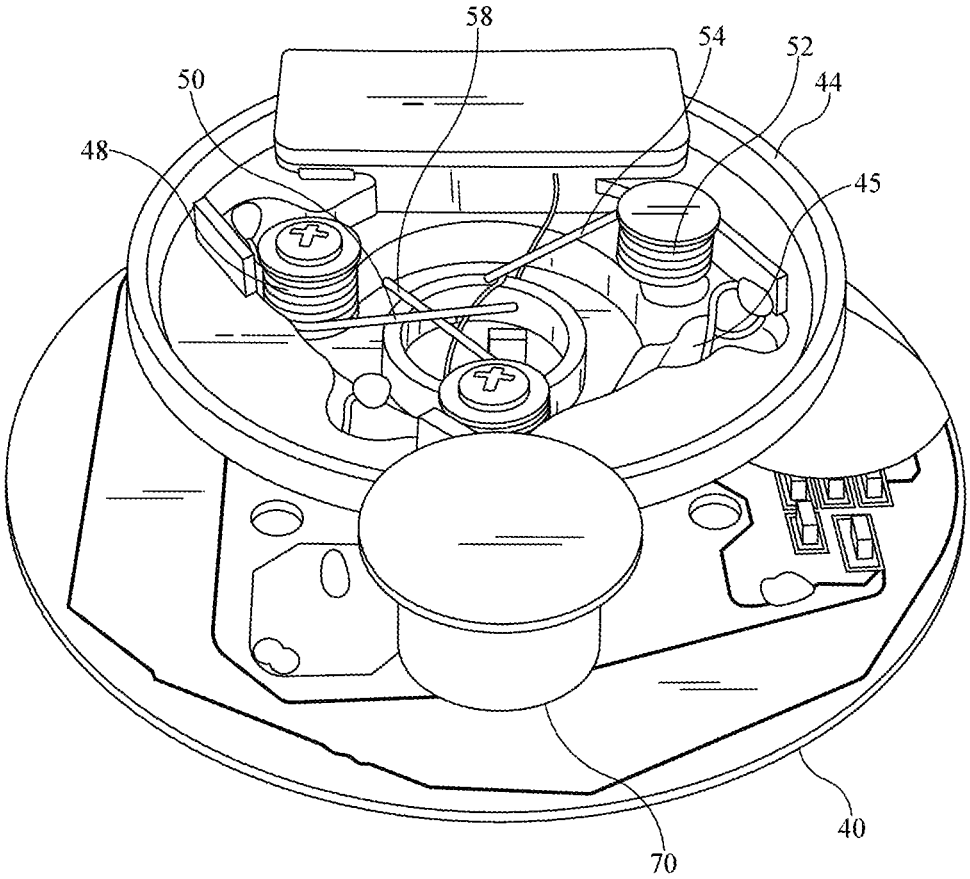
FIG. 8 is a top, perspective view of the printed circuit board and the base of the device of FIG. 1.

As shown in FIGS. 1-3, a counterweight 70 is connected to the base 44 opposite the LED display 72. The counterweight counterbalances the LED display and keeps the base and PCB spinning in synchronization. In another embodiment, not shown, there can be multiple LED displays, wherein, for example, no counterweight would be necessary. Further, as shown in FIGS. 6-7, there can be more than one LED 68, 78 connected to the cover of the base. This LED, for example, can be connected behind the object 74 to further intensify the illumination of said object. The LEDS can vary in color.

As shown in FIG. 3, this embodiment includes an enclosure 80 that connects to a shelf 86 of a top portion of the housing. This enclosure for example, twists into the shelf and is further secured via glue. This enclosure is made of a translucent material so the visual illumination of the LEDs 68, 78 and the LED display 72 can be viewed therethrough. As shown in FIG. 3, this enclosure is made of a front cover 82 and a back cover 84, which connect to each other around the top portion 39 of the device 10. This enclosure not only intensifies the projection of the illumination of the device, but also serves as a protective barrier for the spinning portion of the device, for instance if it is dropped. Moreover, it acts as a safety feature, so children do not get their hands or fingers injured by the spinning features of the device. Although shown in FIGS. 1-7, there are embodiments of the device wherein an enclosure is not utilized.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

LISTING OF ELEMENTS

Illuminating, spinning device 10
Housing 20
Front cover 22
Back cover 24
Battery compartment 26
Cover for battery compartment 27
Batteries 28
Switch 30
Outlet 31
Motor 32
Worm gear 34
Gear box 36
Drive shaft 38
Top portion of the device 39
Printed circuit board 40
Secure point on PCB for LED display 42
Base 44
Encasing 45
Cover for base 46
Negative power spring 48
Extending arm of negative power spring 50
Positive power spring 52
Extending arm of positive power spring 54
Timing circuit spring 56
Extending arm of timing circuit spring 58
Negative power slip ring 60
Negative terminal 61
Positive power slip ring 62
Positive terminal 63
Timing circuit slip ring 64
Gear 66
LED 68
Counterweight 70
LED display 72
Object 74
LEDS 78
Enclosure 80
Front cover of enclosure 82
Back cover of enclosure 84
Shelf on top portion of housing 86

The invention claimed is:

1. An illuminating, spinning device comprising:
- a housing comprising a casing, within which a motor is contained, wherein the motor is electrically connected to a power source,
- a shaft extending from the motor;
- a printed circuit board connected to the shaft;
- a LED display secured to the printed circuit board;
- a base connected to the shaft, wherein the base and the printed circuit board rotate about the shaft;
- a LED secured to a surface of the base; and
- an object secured to the base adjacent to the LED display, wherein the LED display produces a moving animation when rotating about the shaft.

2. The illuminating, spinning device of claim 1, wherein the LED display is secured to an outer edge of the printed circuit board.

3. The illuminating, spinning device of claim 1, wherein the LED display extends vertically from the printed circuit board.

4. The illuminating, spinning device of claim 1, wherein the base further comprises at least one additional LED.

5. The illuminating, spinning device of claim 4, wherein one of the at least one additional LED is secured behind the object.

6. The illuminating, spinning device of claim 1, wherein the housing of the device is shaped to be handheld.

7. The illuminating, spinning device of claim 1, further comprising an enclosure secured to the housing enclosing the printed circuit board and base.

8. The illuminating, spinning device of claim 7, wherein the enclosure is made of a transparent material.

9. The illuminating, spinning device of claim 1, wherein the object is made of a material that refracts light from the LED.

10. An illuminating, spinning device comprising:

a housing comprising a casing, within which a motor is contained, wherein the motor is electrically connected to a power source, a shaft extending from the motor;

a printed circuit board connected to the shaft;

a LED display secured to an outer edge of the printed circuit board and extending therefrom;

a base connected to the shaft, wherein the base and the printed circuit board rotate about the shaft;

a LED secured to a surface of the base; and an object secured to the base adjacent to the LED display, wherein the LED display produces a moving animation when rotating about the shaft.

11. The illuminating, spinning device of claim 10, wherein the housing of the device is shaped to be handheld.

12. The illuminating, spinning device of claim 10, wherein the base further comprises at least one additional LED.

13. The illuminating, spinning device of claim 12, wherein one of the at least one additional LED is secured behind the object.

14. An illuminating, spinning device comprising:

a housing comprising a casing, within which a motor is contained, wherein the motor is electrically connected to a power source, a shaft extending from the motor;

a printed circuit board connected to the shaft;

a LED display secured to an outer edge of the printed circuit board;

a base connected to the shaft, wherein the base and the printed circuit board rotate about the shaft;

a LED secured to a surface of the base;

an object secured to the base adjacent to the LED display, wherein the LED display produces a moving animation when rotating about the shaft; and an enclosure secured to the housing enclosing the LED display, the printed circuit board and the object.

15. The illuminating, spinning device of claim 14, wherein the enclosure is made of a transparent material.

16. The illuminating, spinning device of claim 14, wherein the LED display extends from the printed circuit board.

17. The illuminating, spinning device of claim 14, wherein the housing of the device is shaped to be handheld.

18. The illuminating, spinning device of claim 14, wherein the base further comprises at least one additional LED.

19. The illuminating, spinning device of claim 18, wherein one of the at least one additional LED is secured behind the object.

20. The illuminating, spinning device of claim 14, wherein the object is made of a material that diffuses light from the LED.

* * * * *